US008460107B2

(12) United States Patent
Barclay et al.

(10) Patent No.: US 8,460,107 B2
(45) Date of Patent: Jun. 11, 2013

(54) CONTROLLING AND PRESENTING VIRTUAL WAGERING GAME ENVIRONMENTS

(75) Inventors: Brian J. Barclay, Atlanta, GA (US); Andrew C. Guinn, Chicago, IL (US); Daniel P. Louie, Chicago, IL (US); Richard T. Schwartz, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 157 days.

(21) Appl. No.: 13/122,665

(22) PCT Filed: Oct. 9, 2009

(86) PCT No.: PCT/US2009/060075

§ 371 (c)(1),
(2), (4) Date: Apr. 5, 2011

(87) PCT Pub. No.: WO2010/042773

PCT Pub. Date: Apr. 15, 2010

(65) Prior Publication Data

US 2011/0190066 A1 Aug. 4, 2011

Related U.S. Application Data

(60) Provisional application No. 61/103,989, filed on Oct. 9, 2008.

(51) Int. Cl.
*A63F 9/24* (2006.01)

(52) U.S. Cl.
USPC ..... 463/41

(58) Field of Classification Search
USPC ..... 463/41
See application file for complete search history.

(56) References Cited

U.S. PATENT DOCUMENTS

| | | | |
|---|---|---|---|
| 6,476,830 | B1 | 11/2002 | Farmer et al. |
| 6,887,157 | B2 | 5/2005 | LeMay et al. |
| 7,090,576 | B2 | 8/2006 | Herbrich et al. |
| 7,484,176 | B2 | 1/2009 | Blattner et al. |

(Continued)

FOREIGN PATENT DOCUMENTS

| | | |
|---|---|---|
| WO | WO2009007701 | 1/2009 |
| WO | WO2009114183 | 9/2009 |

(Continued)

OTHER PUBLICATIONS

U.S. Appl. No. 12/968,269, filed Dec. 14, 2010, Guinn, Andrew C., et al.

(Continued)

*Primary Examiner* — Corbett B Coburn
(74) *Attorney, Agent, or Firm* — DeLizio Gilliam, PLLC

(57) ABSTRACT

A wagering game system and its operations are described herein. In embodiments, the operations can include determining a player avatar population in a location of a virtual wagering game environment and determining a wagering game machine object supply in the location of the virtual wagering game environment. The wagering game machine object supply is an amount of available wagering game machine objects within a boundary of the location. The operations can further include determining a supply availability ratio, where the supply availability ratio indicates a restriction on the amount of the available wagering game machine objects in the location compared to the player avatar population. The operations can further include determining that the wagering game machine object supply is not compliant with the supply availability ratio and modifying the wagering game machine object supply to comply with the supply availability ratio.

28 Claims, 10 Drawing Sheets

U.S. PATENT DOCUMENTS

| | | | |
|---|---|---|---|
| 7,636,755 | B2 | 12/2009 | Blattner et al. |
| 2003/0073494 | A1 | 4/2003 | Kalpakian et al. |
| 2003/0188306 | A1 | 10/2003 | Harris et al. |
| 2003/0199313 | A1 | 10/2003 | Gonen |
| 2005/0037845 | A1 | 2/2005 | Rozkin et al. |
| 2005/0137015 | A1 | 6/2005 | Rogers et al. |
| 2005/0227811 | A1 | 10/2005 | Shum et al. |
| 2006/0189371 | A1 | 8/2006 | Walker et al. |
| 2006/0217199 | A1 | 9/2006 | Adcox et al. |
| 2006/0240894 | A1 | 10/2006 | Andrews |
| 2007/0060330 | A1 | 3/2007 | Martin |
| 2007/0077978 | A1 | 4/2007 | Walker et al. |
| 2007/0093299 | A1 | 4/2007 | Bergeron et al. |
| 2007/0197296 | A1 | 8/2007 | Lee |
| 2007/0259713 | A1 | 11/2007 | Fiden et al. |
| 2008/0020788 | A1 | 1/2008 | Griswold et al. |
| 2008/0026838 | A1 | 1/2008 | Dunstan et al. |
| 2008/0070669 | A1 | 3/2008 | Walker et al. |
| 2008/0181535 | A1 | 7/2008 | Steiger |
| 2009/0023489 | A1 | 1/2009 | Toneguzzo |
| 2009/0044113 | A1 | 2/2009 | Jones et al. |
| 2009/0124386 | A1 | 5/2009 | LaMontagne |
| 2009/0156179 | A1 | 6/2009 | Hahn et al. |
| 2009/0158170 | A1 | 6/2009 | Narayanan et al. |
| 2010/0121915 | A1 | 5/2010 | Wang |
| 2010/0137067 | A1 | 6/2010 | Kobayashi et al. |
| 2010/0227682 | A1 | 9/2010 | Reville et al. |
| 2011/0143834 | A1 | 6/2011 | Guinn et al. |
| 2011/0201414 | A1 | 8/2011 | Barclay et al. |
| 2012/0322550 | A1 | 12/2012 | Antkowiak et al. |

FOREIGN PATENT DOCUMENTS

| | | |
|---|---|---|
| WO | WO2010028064 | 3/2010 |
| WO | WO2010042773 | 4/2010 |
| WO | WO-2012019167 | 2/2012 |

OTHER PUBLICATIONS

Lamacraft, Brian, "Facebook Game Review: Casino City", *Bright Hub* http://www.brighthub.com/video-games/social/reviews/78485.aspx Date Obtained from the Internet: Nov. 16, 2010 Jul. 20, 2010, 3 pages.

Phantom EFX, , "Reel Deal Live", http://reeldealliveonline.com/pages/about-the-game Date Obtained from the Internet: Nov. 16, 2010, 3 pages.

"PCT Application No. PCT/US11/46860 International Search Report", Jan. 5, 2012 , 9 pages.

U.S. Appl. No. 13/295,056, filed Nov. 12, 2011, Allen, Jeffrey L., et al.

"Leapfrog Online Bingo Software Review", garysmomsbingopage.com http://www.garysmomsbingopage.com/leapfrog.htm , Last Date Modified: Jul. 17, 2008 , 1-2 pages.

"PCT Application No. PCT/US09/60075 International Preliminary Report on Patentability", Sep. 20, 2010 , 4 pages.

"PCT Application No. PCT/US09/60075 International Search Report", Jan. 26, 2010 , 10 pages.

"PCT Application No. PCT/US11/46860 International Preliminary Report on Patentability", Aug. 6, 2012, 4 pages.

"U.S. Appl. No. 12/968,269 Office Action", Feb. 22, 2013, 15 pages.

"U.S. Appl. No. 13/295,056 Non Final Office Action", Apr. 1, 2013, 17 pages.

CONTROLLING AND PRESENTING VIRTUAL WAGERING GAME ENVIRONMENTS

RELATED APPLICATIONS

This application claims the priority benefit of U.S. Provisional Application Ser. No. 61/103,989 filed Oct. 9, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

TECHNICAL FIELD

Embodiments of the inventive subject matter relate generally to wagering game systems and networks that, more particularly, control and present virtual wagering game environments.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a method comprises determining a player avatar population in a location of a virtual wagering game environment; determining a wagering game machine object supply in the location of the virtual wagering game environment, wherein the wagering game machine object supply is an amount of available wagering game machine objects within a boundary of the location; determining a supply availability ratio, wherein the supply availability ratio indicates a restriction on the amount of the available wagering game machine objects compared to the player avatar population for the location; determining that the wagering game machine object supply is not compliant with the supply availability ratio; and modifying the wagering game machine object supply to comply with the supply availability ratio.

In some embodiments, the method further comprises referring to a rule set to determine the supply availability ratio, wherein the rule set includes supply rules that govern the amount of the available wagering game machine objects in the location.

In some embodiments, modifying the wagering game machine object supply comprises positioning one or more player bots at one or more of the available wagering game machine objects making the one or more of the available wagering game machine objects unavailable.

In some embodiments, modifying the wagering game machine object supply comprises removing one or more of the one or more of the available wagering game machine objects from the location.

In some embodiments, removing the one or more of the available wagering game machine objects according to performance statistics.

In some embodiments, the method further comprises presenting a secret wagering game machine object to a wagering game player account.

In some embodiments, one or more machine-readable media having instructions stored thereon, which when executed by a set of one or more processors causes the set of one or more processors to perform operations comprises presenting a virtual wagering game machine object in a virtual wagering game environment; presenting a purchase control to purchase rights to access one or more control abilities of the virtual wagering game machine object, wherein the one or more control abilities control access to one or more functions of the virtual wagering game machine object; determining a selection of the purchase control by a user account; presenting purchase terms for the rights to access the one or more control abilities of the virtual wagering game machine object; receiving a purchase value from the user account; and presenting the user account with access to the one or more control abilities to the virtual wagering game machine object.

In some embodiments, the purchase value is one or more virtual currency, credits, points, and money.

In some embodiments, the operations further comprise setting a time limit for access to the one or more control abilities; determining that the time limit expires; and revoking access to the one or more control abilities.

In some embodiments, the one or more control abilities include abilities to perform one or more of controlling access to the virtual wagering game machine object, controlling a waiting list for the virtual wagering game machine object, controlling customizations for the virtual wagering game machine object, and controlling sponsorship rights to the virtual wagering game machine object.

In some embodiments, the operations further comprise providing a sponsor item as a gift from the user account for accessing the virtual wagering game machine object, and providing a reward to the user account for providing the sponsor item.

In some embodiments, the operations further comprise requiring the user account to accomplish an objective before presenting the purchase control.

In some embodiments, the operations further comprise determining a social network status for the user account; and presenting the purchase control based on the social network status.

In some embodiments, the operations further comprise providing a referral award to the user account for referring one or more additional user accounts to the virtual wagering game machine object.

In some embodiments, a system comprises an account server configured to store a wagering game player account, wherein the wagering game player account includes financial information for placing wagers on wagering game activity; a computer system comprises a machine object controller configured to present a control configured to obtain a wager amount from the wagering game player account, during a first wagering game session, wherein the wager amount applies to a second wagering game session, by a wagering agent player account, on a wagering game machine object in a virtual wagering game environment, and store the wager amount; and a wagering game server comprises a machine abilities controller configured to determine a wagering game win value from the wagering game play of the wagering agent player account on the wagering game machine object during the second wagering game session, and provide, to the wagering game player account, an amount equivalent to a portion of the wagering game win value.

In some embodiments, the machine abilities controller is further configured to determine that the wagering game win occurs within one or more of a time limit and number of game plays of the second wagering game session.

In some embodiments, the machine abilities controller is further configured to control abilities of the wagering game machine object based on social status points for one or more of the wagering game player account and the wagering agent player account.

In some embodiments, the machine object controller is configured to control the abilities by performing one or more of modifying denomination values for the wagering game machine object based on the social status points, presenting abilities to move up on a wait list based on the social status points, present controls to control the machine based on the social status points, and present secret machines based on the social status points.

In some embodiments, an apparatus comprises a wagering game module configured to present a virtual wagering game machine object in a virtual wagering game environment, present a personalization control to personalize a portion of the virtual wagering game machine object, determine a selection of the personalization control by a player account which indicates a request to make the portion of the virtual wagering game machine object personalized to the player account, and personalize the portion of the virtual wagering game machine object according to the request.

In some embodiments, the wagering game module is further configured to determine that the player account has access rights to personalize the virtual wagering game machine object.

In some embodiments, the wagering game module is configured to personalize the portion of the virtual wagering game machine object by placing on the virtual wagering game machine object one or more of a player's signature, a player's symbol, a player's initials, a player's avatar image, and a player's note.

In some embodiments, an apparatus comprises means for determining a payout value for a wagering game machine object in an virtual wagering game environment, wherein the payout value indicates an amount of winnings that the wagering game machine object has paid out over a period of time; means for determining a threshold setting set by a player account where the threshold setting indicates a threshold limit for the payout value which the player account desires to monitor; means for determining that the payout value reaches the threshold limit; and means for automatically activating functions within the virtual wagering game environment after the payout value reaches the threshold limit.

In some embodiments, the means for automatically activating functions within the virtual wagering game environment further comprises means for performing one or more of notifying the player account that the payout value has reached the threshold limit, placing the player account on a waiting list to play the wagering game machine object, sending a player bot to occupy the wagering game machine object until a player avatar can arrive, transporting a player account's avatar to the wagering game machine object, notifying a wagering game agent to play the wagering game machine object, triggering an agent investment for the wagering game machine object, and placing side-bets on activity on the wagering game machine object.

In some embodiments, the apparatus further comprises means for calculating an expected payout value for the wagering game machine object, wherein the expected payout value equates to a composite score of factors comprising one or more of a number of bonus awards awarded over time, a number of jackpots awarded over time, a number of player winnings over time, a record of wins since the player has last played on that machine, and a number of wins over a number of spins; and means for presenting the expected payout value to the player account.

In some embodiments, the apparatus further comprises means for receiving a payout search parameter, wherein the payout search parameter includes a search value that correlates to a payout value possessed by the wagering game machine object and one or more additional wagering game machine objects in the virtual wagering game environment; and means for searching the virtual wagering game environment using the payout search parameter to find one or more of the wagering game machine object and the one or more additional wagering game machine objects with individual payout values that match the search value.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Figure 1:
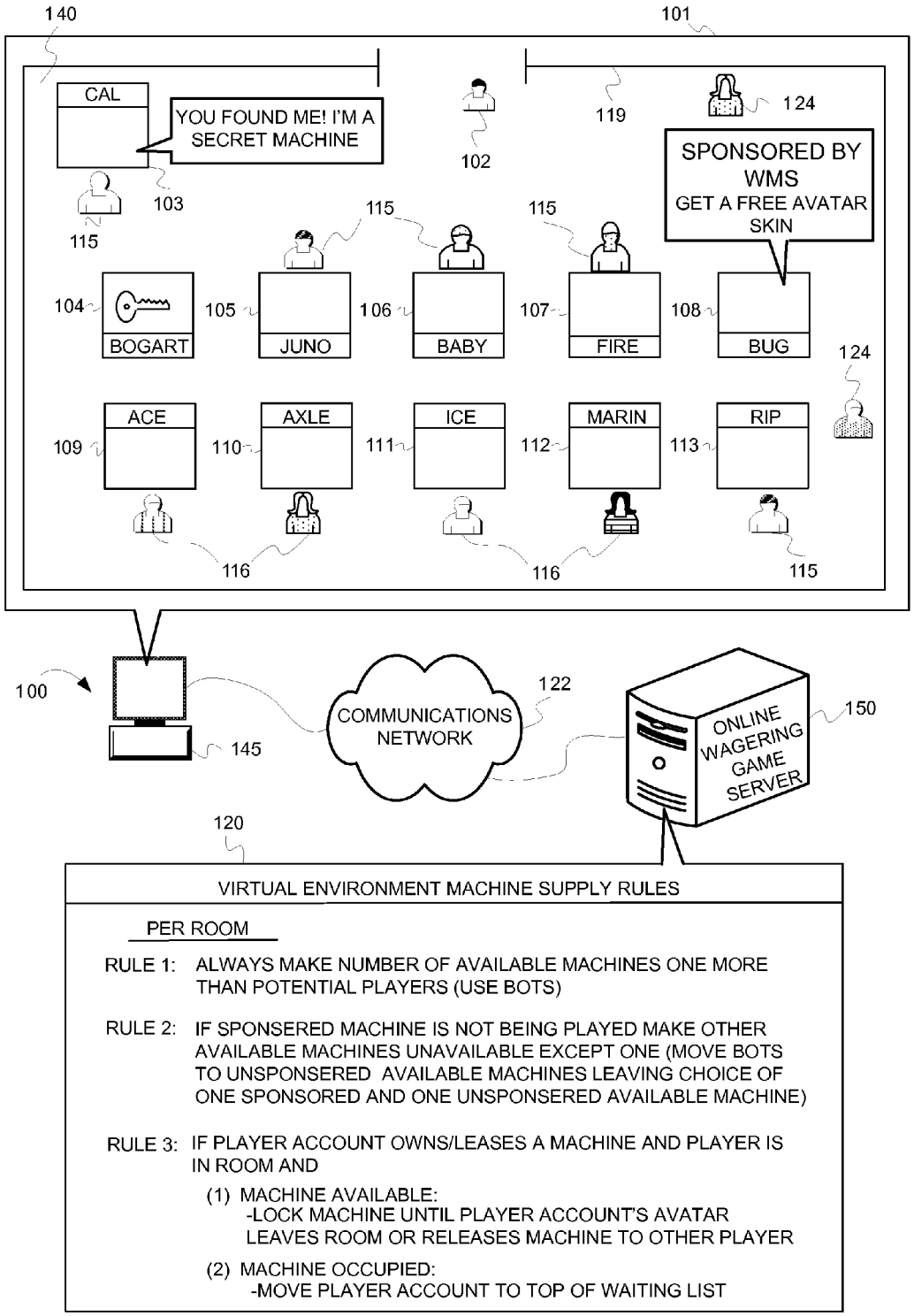
FIG. 1 is an illustration of presenting online casino objects in virtual wagering game environment, according to some embodiments.

Wagering games are expanding in popularity. Many gamers are demanding greater access to wagering games and content related to wagering games. As a result, some wagering game companies have created social network sites that provide a way for wagering game enthusiasts to congregate and share their passion for wagering games. A social network site allows social network users to create user accounts with one or more unique identifiers that represent an online persona. One example of a unique identifier is an "avatar". Avatars are graphical, "cartoon-like" depictions of a social network persona. These online personas and associated avatars add to the fun of belonging to a social network. However, social networks face challenges appealing to wagering game enthusiasts who enjoy a more true-to-life gaming experience. Hence, some embodiments of the inventive subject matter enable wagering game companies to combine the fun of social networks with the enjoyment and excitement derived from playing wagering games in a way that emulates a casino environment. Some embodiments describe ways for player accounts to communicate and share information via online casino objects specifically configured to function with background information, casino ambience, and customizable communication and presentation functionality. FIG. 1 shows an example wagering game system ("system") 100, configured with online casino environment objects.

Figure 3:
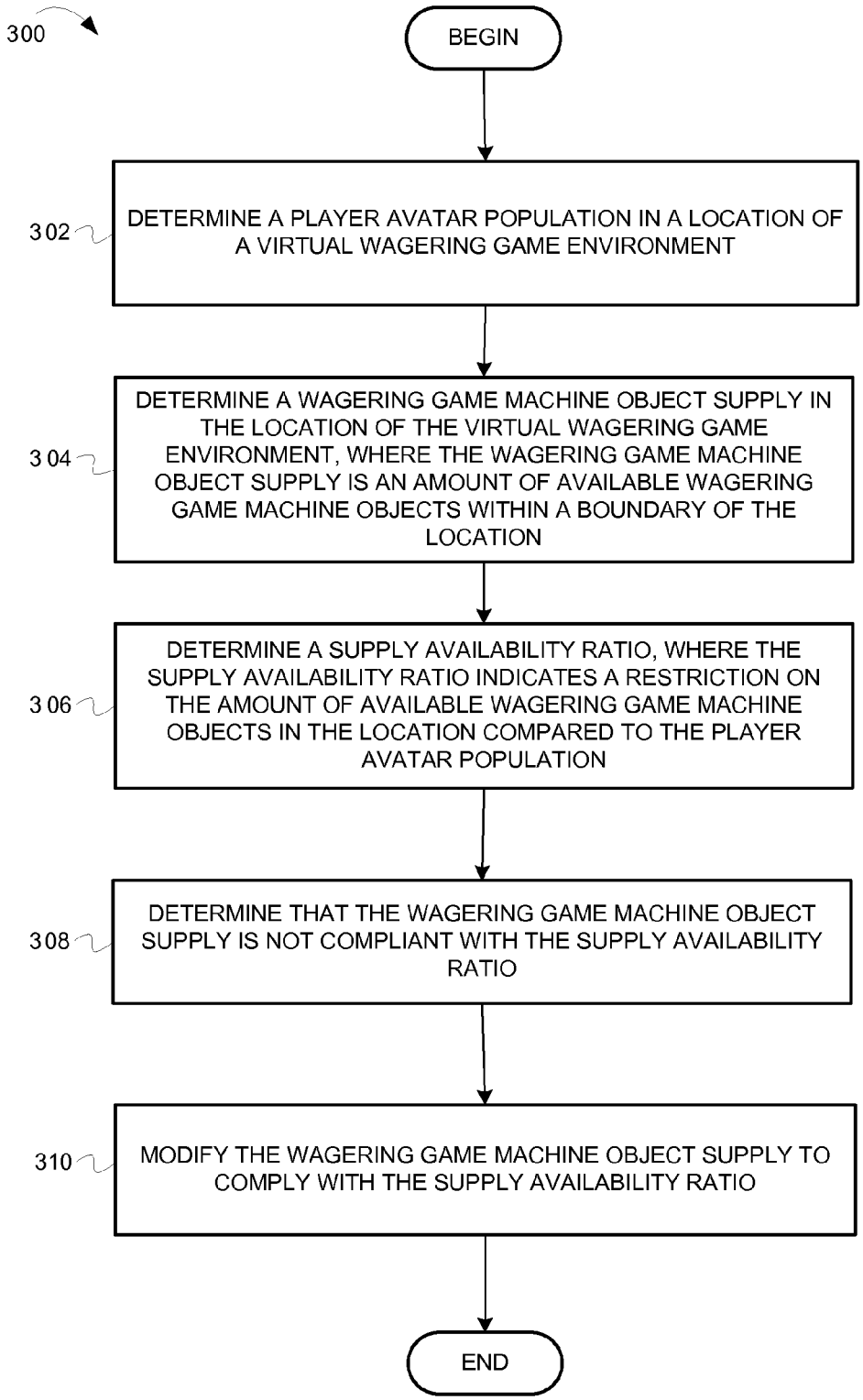
FIG. 3 is a flow diagram 300 illustrating controlling a wagering game machine object supply, according to some embodiments.

FIG. 1 is a conceptual diagram that illustrates an example of presenting online casino objects in virtual wagering game environment, according to some embodiments. In FIG. 1, the wagering game system ("system") 100 includes an online wagering game server 150 connected to a client computer system ("computer") 145 via a communications network 122. The online wagering game server 150 can also be connected to a casino network (not shown), including one or more casino network devices associated with a casino network, such as wagering game servers, account servers, wagering game machines, or other devices. The online wagering game server 150 hosts an online casino. The online wagering game server 150 can provide one or more online casino objects. The computer 145 has a display 101 that can display the various online casino objects in a virtual wagering game environment. The online casino objects represent items, people, machines, etc. often seen and heard within a physical, "brick-and-mortar" casino. The online casino objects, however, are representations in the form of computer objects that act and interact with player accounts that access the system 100 (e.g., via the computer 145). The online wagering game server 150 can present wagering game machine objects 103, 104, 105, 106, 107, 108, 109, 110, 111, 112, and 113 ("machine objects" 103-113), which player accounts can use to play wagering games. For example, one or more avatars (e.g., a potential player avatar 102 and player avatars 115) for player accounts can select any of the machine objects 103-113 that are available and the system 100 can present wagering games on the machine objects 103-113. In some embodiments, the system can control the supply of the machine objects 103-113, by artificially occupying some of the machine objects 103-113 based on supply rules 120. The supply rules 120 can indicate rules governing ratios of available machine objects compared to potential player avatars. In other words, the system 100 reduces the available number of wagering game machine objects based on a number of potential player avatars (e.g., the potential player avatar 102) in a virtual room 140 that are not currently occupying one of the machine objects 103-113. In some embodiments, to artificially occupy some of the machine objects 103-113, the system 100 can present canned characters, or bots (e.g., player bots 116 and roaming bots 124), that can occupy any of the machine objects 103-113, that are available, to reduce the wagering game machine object supply. By doing so, the system 100 provides the perception that available wagering game machine objects (e.g., the machine objects 104 and 108) are scarce and, therefore, according to the economic rule of supply and demand, more valuable or desirable. For example, when the player bots 116 occupy the available wagering game objects 109, 110, 111, and 112, the potential player avatar 102 may perceive that the available machine objects 104 and 108 are limited, and thus encourage the potential player avatar 102 to quickly claim one of the available machine objects 104 and 108 so that the player doesn't have to wait in line for a machine. In some embodiments, the system 100 may present the roaming bots 124 to have the appearance of player account avatars. The system 100 can also place the roaming bots 124 in close proximity to available machines (e.g., the system 100 positions the roaming bots 124 close to the available machine object 108) to further encourage the potential player avatar 102 to act quickly to secure the machine object 108. The system 100 can also give the impression, via the use of the player bots 116, that the machine objects 103-113 are consistently in use, thus presenting the impression that the games on the machine objects 103-113 are interesting and worth playing. FIG. 3 illustrates more embodiments of controlling supply of wagering game machine objects.

According to some embodiments, the wagering game system 100 can include numerous capabilities and configurations. The following non-exhaustive list enumerates some example capabilities and configurations:

- The machine objects 103-113 can have waiting lists, where a player account can place their name, or other identifier, on the waiting list. The system 100 can then notify the player account when the wagering game machine object is available (e.g., the system can notify the player account when the player account's name rises to the top of a waiting list for the wagering game machine object).
- In some embodiments, the machine objects 103-113 can each have a unique identity and may include a specific name (e.g., Cal, Bogart, Juno, etc.), a unique appearance, a unique identification number, etc.
- In some embodiments, the system 100 can provide wagering game machine objects with different combinations of abilities (see FIGS. 7 and 8).
- In some embodiments, the system 100 can present controls for a player to personalize (e.g., customize, modify) portions of the machine objects 103-113 (see FIGS. 4, 5 and 6).
- In some embodiments, the system 100 can present notifications or search controls to find wagering game machine objects that have specific performance histories (e.g., see FIGS. 7 and 8).
- In some embodiments, the system 100 can present secret items (e.g., a secret machine 103, a secret room, a secret game option, etc.). The system 100 can present the secret items as part of a wagering game (e.g., a player wins a bonus award that reveals a location of a secret item), or in other ways (e.g., a player is waiting in line for a wagering game machine object and the system 100 reveals the location of a secret wagering game machine object).

In some embodiments, the system 100 can provide a sponsored item as a gift to the user account for accessing a sponsored wagering game machine object (e.g., machine object 108). The system 100 can provide the sponsor with some reward (e.g., share some percentage of losses on the sponsored wagering game machine object) for providing the sponsored gift or item.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
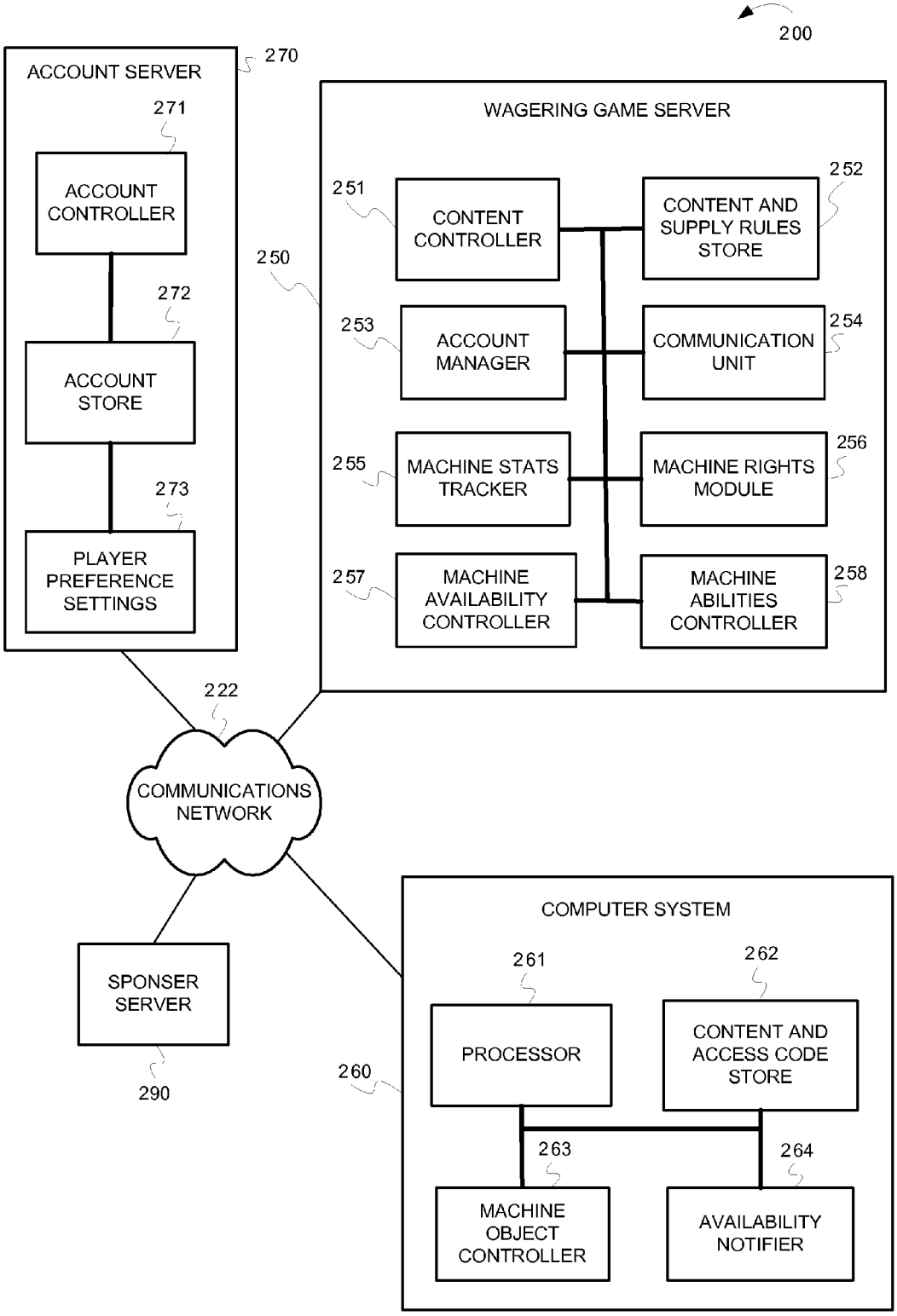
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller 271 configured to control information for a player's account. The account server 270 can also include an account store 272 configured to store information for a player's account. The account server 270 can also include a player preference settings 273 configured to store settings for personalization, customization, ownership, and other player account settings related to wagering game machine object abilities and for use in a virtual wagering game environment.

The wagering game system architecture 200 can also include an online wagering game server ("wagering game server") 250 configured to control wagering game content, provide random numbers, and communicate wagering game information, account information, and other information to and from a computer system ("computer") 260. The wagering game server 250 can include a content controller 251 configured to manage and control content for the presentation of content on the computer 260. For example, the content controller 251 can generate game results (e.g., win/loss values), including win amounts, for games played on the computer 260. The content controller 251 can communicate the game results to the computer 260. The content controller 251 can also generate random numbers and provide them to the computer 260 so that the computer 260 can generate game results. The wagering game server 250 can also include a content store 252 configured to contain content to present on the computer 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the computer 260 and to communicate with other systems, devices and networks. The wagering game server 250 can also include a machine stats tracker 255 configured to track machine performance, payout values, and other statistics for wagering game machine objects. The wagering game server 250 can also include a machine rights module 256 configured to control ownership, leasing, reservations, and other controlled access rights for wagering game machine objects. In some embodiments, the machine rights module 256 can work in conjunction with a sponsor server 290 hosted by sponsors that offer gifts to player accounts for using sponsored wagering game machine objects. The wagering game server 250 can also include a machine availability controller 257 configured to control availability of wagering game machine object supplies in rooms of a virtual wagering game environment. The wagering game server 250 can also include a machine abilities controller 258 configured to control abilities of wagering game machine objects.

The wagering game system architecture 200 can also include the computer 260 configured to present wagering games and receive and transmit information to control and present virtual wagering game environments. The computer 260 can include a processor 261 configured to process wagering game content and online wagering game objects, and present online casino content on the computer 260. The computer 260 can also include a content and access code store 262 configured to contain content and other information to present on the computer 260. The content and access code store is also configured to contain keys and access codes that the computer 260 can use to access abilities of wagering game machine objects. The computer 260 can also include a machine object controller 263 configured to personalize portions of wagering game machine objects, control access to control abilities for wagering game machine objects, facilitate purchasing of rights for wagering game machine objects, etc. The computer 260 can also include an availability notifier 264 configured to notify player accounts of available wagering game machine objects.

Each component shown in the wagering game system architecture 200 is shown as a separate and distinct element connected via a communications network 222. However, some functions performed by one component could be performed by other components. For example, the wagering game server 250 can also be configured to perform functions of the content and access code store 262, the machine object controller 263, the availability notifier 264, and other network elements and/or system devices. Furthermore, the components shown may all be contained in one device, but some, or all, may be included in, or performed by multiple devices, as in the configurations shown in FIG. 2 or other configurations not shown. Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

FIG. 3 is a flow diagram ("flow") 300 illustrating controlling a wagering game machine object supply, according to some embodiments. FIG. 1 is a conceptual diagram that helps illustrate the flow of FIG. 3, according to some embodiments. This description will present FIG. 3 in concert with FIG. 1. In FIG. 3, the flow 300 begins at processing block 302, where a wagering game system ("system") determines a player avatar population in a location of a virtual wagering game environment. For example, in FIG. 1, at any given time, a population of player avatars 102 and 115 occupy the virtual room 140 of a virtual wagering game environment. The virtual room 140 is enclosed by a boundary 119. The online wagering game server 150 hosts the virtual room 140 within a virtual wagering game environment that tracks the player avatars 102 and 115, within a virtual grid (e.g., including regions, areas, etc.). The player avatars 102 and 115 include both avatars (e.g., the potential player avatar 102) that are not playing wagering games with wagering game machine objects 103-113, and avatars (e.g., the player avatars 115) that are playing wagering games with some of the machine objects 103-113.

The flow 300 continues at processing block 304, where the system determines a wagering game machine object supply in the location of the virtual wagering game environment, where the wagering game machine object supply is an amount of available wagering game machine objects within the boundary of the location. For example, in FIG. 1, the wagering game machine object supply constitutes the machine objects 103-113 that players can potentially use to play wagering games. The machine objects 103-113 occupy the boundary 119 of the virtual room 140. The system 100 determines how many of the machine objects 103-113 are available for play considering machine object maintenance, use, or other factors that cause the machine objects 103-113 to be unavailable.

The flow 300 continues at processing block 306, where the system determines a supply availability ratio, where the supply availability ratio indicates a restriction on the amount of available wagering game machine object in the location compared to the player avatar population. In some embodiments, the system can determine the supply availability ratio according to a rules set governing the supply of the available wagering game machine objects in the location. FIG. 1 illustrates an example.

The flow 300 continues at processing block 308, where the system determines that the wagering game machine object supply is not compliant with the supply availability ratio. For instance, in FIG. 1, if, for instance, the supply rules 120 indicate that the system 100 should present as available only one more of the machine objects 103-113 than the player avatars 115 plus the potential player avatar 102. The system 100 counts the number of player avatars (e.g., the potential player avatar 102 and the player avatars 115), excluding the player bots 116, and determines that too many of the machine objects 103-113 are available. The system 100 is configured, therefore, to subsequently reduce the supply of the available machine objects 103-113.

The flow 300 continues at processing block 310, where the system modifies the wagering game machine object supply to comply with the supply availability ratio. In some embodiments, the wagering game machine object supply comprises positioning one or more player bots (e.g., the player bots 116) at one or more of the available wagering game machine objects making the one or more of the available wagering game machine objects unavailable. For example, the system can occupy and/or remove machines so that there are (1) only slightly more available wagering game machine objects than the number of potential players (e.g., one more available wagering game machine than potential players), (2) an equal number of wagering game machine objects as potential players, or (3) only slightly fewer available wagering game machine objects than the number of potential players (e.g., one less wagering game machine than available players so that players are encouraged to sit down quickly at available machines to avoid having to be on a waiting list). In some embodiments the number of available wagering game machine objects can be controlled via the use of player bots (e.g., canned avatars, system generated virtual players, etc.). FIG. 1 illustrates in detail how the system 100 uses the player bots 116 to occupy any of the available machine objects 103-113 to comport with the supply rules 120. In some embodiments, however, the supply rules 120 can have overrides. For instance the rules may require that if a sponsored machine is unavailable, then the system may make unavailable all other available wagering game objects except the sponsored machine or leave a limited option of other wagering game machine objects (e.g., make unavailable all but one unsponsored wagering game machine object and one sponsored wagering game machine object). In some embodiments, the system can modify the wagering game machine object supply by removing one or more of the available wagering game machine objects from the location. In some embodiments, the system can remove available wagering game machine objects according to performance. For example, the system can retire machines that receive a certain level of play (e.g., remove the least used machines). The system could also remove machines according to player settings. For instance, a player could set a setting that indicates that it only wants to see machines in a room that haven't hit jackpots or bonuses for a certain period of time, or vice versa, machines that have hit bonus and jackpots recently. In some embodiments, the system can present a secret wagering game machine object to a wagering game player waiting for an available wagering game machine object (e.g., the system present a secret wagering game machine object to prevent a player from waiting too long for a wagering game machine object).

Figure 4:
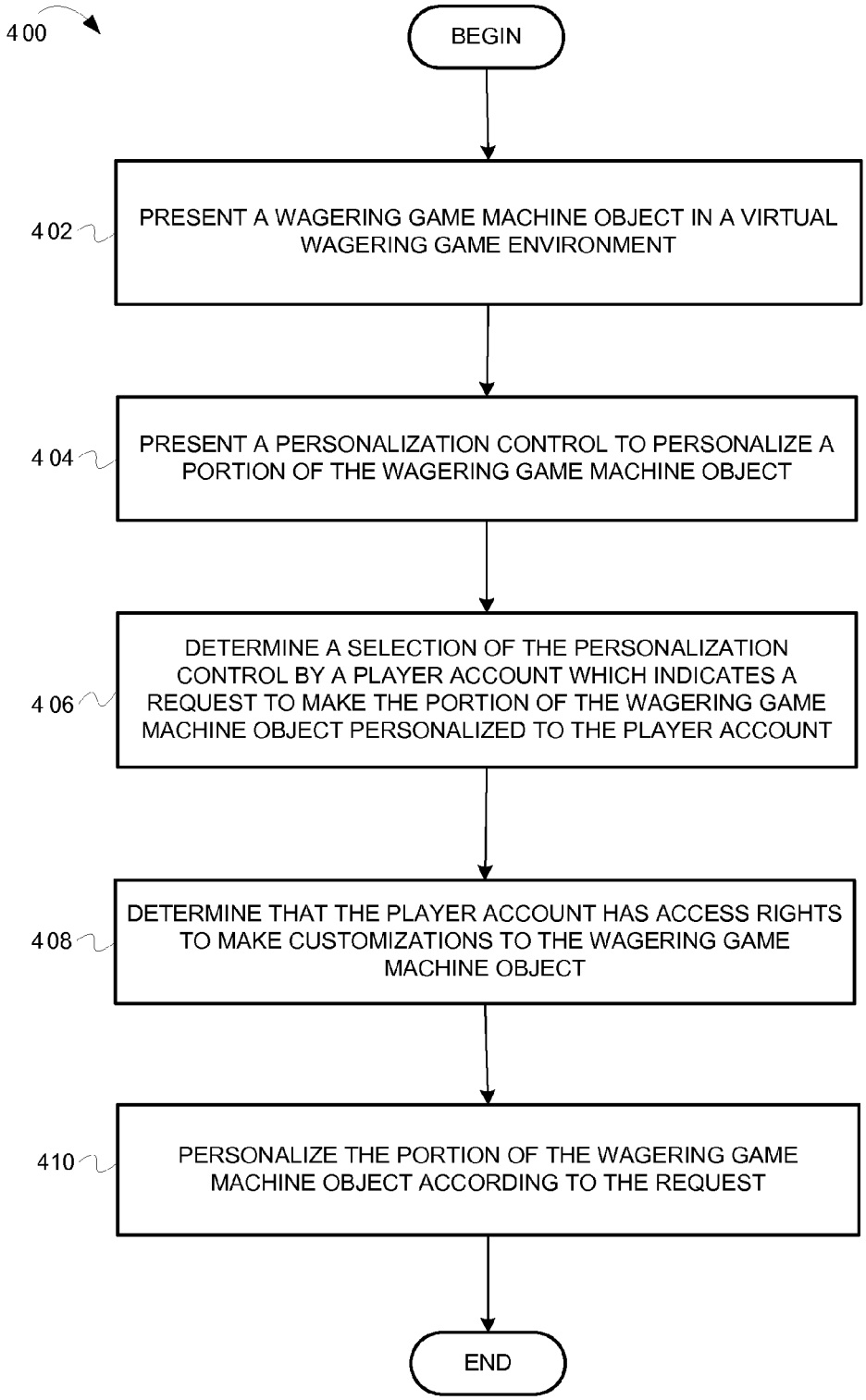
FIG. 4 is a flow diagram 400 illustrating personalizing wagering game machine objects, according to some embodiments.
Figure 6:
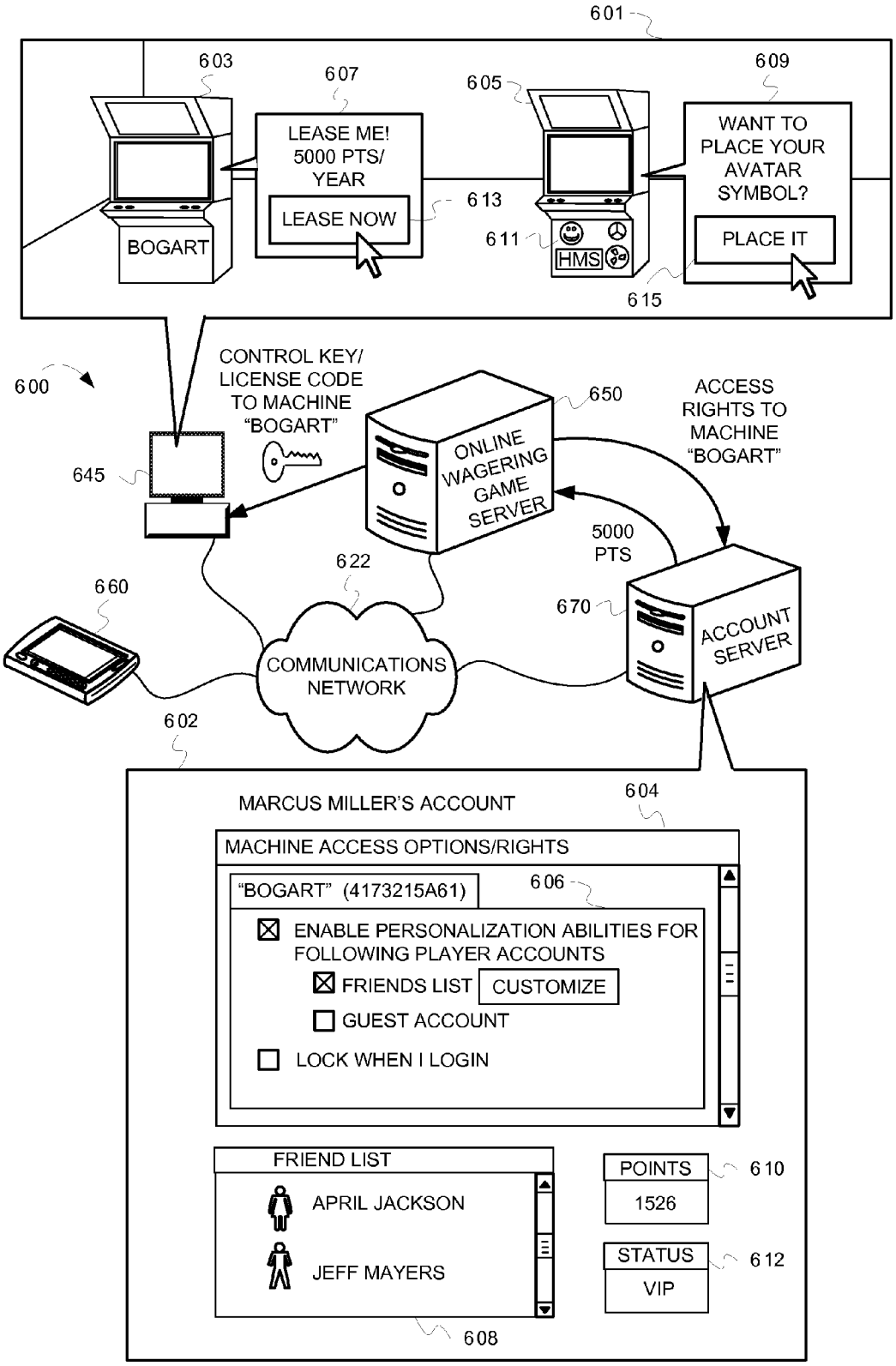
FIG. 6 is an illustration of controlling customization and access rights to wagering game machine objects, according to some embodiments.

FIG. 4 is a flow diagram ("flow") 400 illustrating personalizing wagering game machine objects, according to some embodiments. FIG. 6 is a conceptual diagram that helps illustrate the flow of FIG. 4, according to some embodiments. This description will present FIG. 4 in concert with FIG. 6. In FIG. 4, the flow 400 begins at processing block 402, where a wagering game system ("system") presents a wagering game machine object in a virtual wagering game environment. FIG. 6 illustrates example wagering game machine objects 603 and 605 in a virtual wagering game environment. In FIG. 6, a wagering game system ("system 600") includes a computer system ("computer") 645 connected to an online wagering game server 650 via a communications network 622. The computer 645 presents a display 601 of a virtual wagering game environment hosted by the online wagering game server 650. The system 600 can also include an account server 670 and a wagering game machine 660, both connected to the communications network 622. The account server 670 can store and present control options for a player account that logs in to the virtual wagering game environment through the computer 645. The wagering game machine 660 can also access the virtual wagering game environment and present the display 601 from within a casino network.

The flow 400 continues at processing block 404, where the system presents a personalization control to personalize a portion of the wagering game machine object. For example, in FIG. 6, the wagering game machine object 605 presents one type of personalization control, specifically control options 609 to place an avatar symbol on the wagering game machine object 605. In some embodiments, the system 600 can prompt the player account to select a portion of the exterior of the wagering game machine object 605. The system 600 can also prompt the player to select one or more symbols 611 (e.g., a pre-selected avatar symbol, initials, a favorite quote) that can be placed on the wagering game machine object 605. The wagering game machine object 603 presents another type of personalization control, specifically a rights control 607 to obtain rights to customize and/or exclusively utilize the wagering game machine object 603. The system 600 can write personalization information to metadata (e.g., the system 600 can write ownerships rights to a configuration file, a database record, or some other storage location).

The flow 400 continues at processing block 406, where the system determines a selection of the personalization control by a player account. The selection of the personalization control indicates a request to make the portion of the wagering game machine object personalized to the player account. For instance, in FIG. 6, a player account can select a control button 615 to initiate a process to write the avatar symbol to the wagering game machine object 605. Similarly, the player account can select the control button 613 to initiate a process to lease the wagering game machine object 603 (see FIG. 5). By selecting the buttons 613, 615, the player account The flow 400 continues at processing block 408, where the system determines that the player account has access rights to make customizations to the wagering game machine object. In some embodiments, the system can have safe-guards to ensure that personalizations are made by approved player accounts, in appropriate ways. For instance, although some wagering game machine objects may be free to personalize in any way without any kind of verification procedure, other wagering game machine objects may require that a player account pre-register (e.g., sign a digital signature, click on a verification picture, etc.) to prove that the player account is a valid player account and not a spam program. Some wagering game machine objects may require stricter verifications, such as requiring passwords, access codes, encryption secrets, card swipes, digital certificates, fingerprint scans, and/or other security checks, to access personalization controls for the wagering game machine object.

The flow 400 continues at processing block 410, where the system personalizes the portion of the wagering game machine object according to the request. In some embodiments, the system can place on the wagering game machine object one or more of a player's signature, a player's symbol, a player's initials, a player's avatar image, a player's note, etc. For example, player accounts may leave notes on the wagering game machine objects for other player accounts (e.g., friend accounts) to find and read. The system can also provide security options to lock the personalizations so that only player accounts with permission can see the personalizations.

Figure 5:
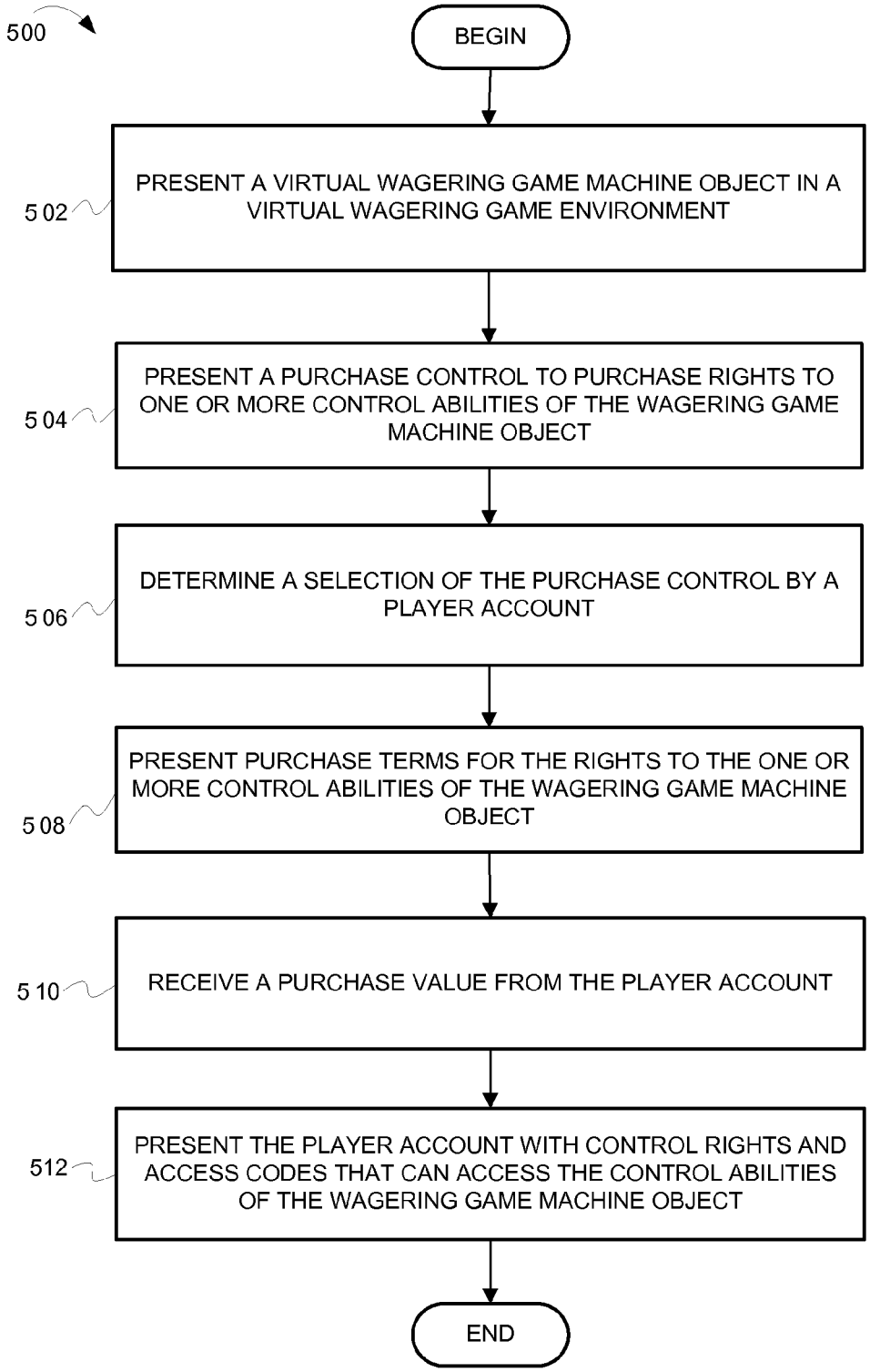
FIG. 5 is a flow diagram 500 illustrating controlling ownership and access rights to wagering game machine objects, according to some embodiments.

FIG. 5 is a flow diagram ("flow") 500 illustrating controlling ownership and access rights to wagering game machine objects, according to some embodiments. FIG. 6 is a conceptual diagram that helps illustrate the flow of FIG. 5, according to some embodiments. This description will present FIG. 5 in concert with FIG. 6. In FIG. 5, the flow 500 begins at processing block 502, where a wagering game system ("system") presents a virtual wagering game machine object in a virtual wagering game environment. As described previously, in FIG. 6, the system presents the wagering game machine object 603, which is configured to provide ownership rights.

The flow 500 continues at processing block 504, where the system presents a purchase control to purchase rights to one or more control abilities of the wagering game machine object. For example, in FIG. 6, the wagering game machine object 603 presents the rights control 607 for acquiring ownership, leasing, or other rights. The rights control 607 indicate a purchase price for obtaining the rights (e.g., 5000 points to lease the wagering game machine object 603 for a year). In some embodiments, the system 600 can require that a user account (e.g., a player account, a sponsor account, etc. accomplish an objective before presenting the purchase control. For example, the system 600 could require that a player hit a high score on a wagering game before receiving the abilities to view purchase controls in a virtual wagering game environment.

The flow 500 continues at processing block 506, where the system determines a selection of the purchase control by a player account. In FIG. 6, the system 600 presents the control button 613 to initiate a purchase agreement.

The flow 500 continues at processing block 508, where the system presents purchase terms for the rights to the one or more control abilities of the wagering game machine object. For instance, in FIG. 6, the system 600 can present additional information before the player ultimately agrees to purchase rights in the wagering game machine. For example, the system 600 can present the terms of the agreement, a list of the control abilities the player account will purchase rights to, conditions of use, penalties, benefits, etc. The system 600 can present various purchase values and/or methods of payment, including payment by entertainment points that a player has earned via wagering game activity, social status points, credits, virtual currency, money, promises to complete tasks, or any other item or service of tradable value. The system 600 can also conduct auctions to purchase the rights.

The flow 500 continues at processing block 510, where the system receives a purchase value from a player account. For example, in FIG. 6, the player can agree to the terms of purchase and submit a purchase value. The account server 670 presents a player account interface ("player interface 602"), showing a points meter 610. The system 600 can deduct the purchase value (e.g., 5000 points) from the points meter 610 and transmit the purchase value to the online wagering game server 650.

The flow 500 continues at processing block 512, where the system presents the player account with a control rights and/or access codes that can access the control abilities of the wagering game machine object. For example, in FIG. 6, if the purchase value that the player sent at processing block 510 matches the purchase price for the rights, the online wagering game server 650 can send access rights to the account server 670. The account server 670 can allocate the rights to the player's account and present a machine access options and rights settings ("machine options settings 604"). The machine options settings 604 can store and indicate the unique identity information for specific wagering game machine objects. Sub-settings 606 indicate settings for the wagering game machine object 603 (e.g., nickname "Bogart", identification number "4173125A61", etc.). In some embodiments, the system can set a time limit to the control key for access to the control abilities. For example, the rights can be lease rights that expire after a year, a month, or some other agreed upon time period. In some embodiments, the rights can be non-exclusive and/or intermingled throughout the period (e.g., a shared ownership, a time share). In some embodiments, the system 600 can read from settings within the machine options settings 604 for controlling wagering game machine object behavior. For instance, in FIG. 1, the player account corresponding to the potential player avatar 102 may own access rights to the machine object 104. The system 100 can, detect that the player account owns rights to the machine object 104, determine settings (e.g., from the sub-settings 606 from the machine options settings 604) and lock the machine object 104 when the potential player avatar 102 enters the boundary 119 of the virtual room 140. If the machine object 104 is being used when the potential player avatar 102 enters the virtual room 140, the system can place the player account for the potential player avatar 102 on the top of the waiting list above any other accounts signed up on the waiting list. The system 100 can utilize the player account settings (e.g., the machine option settings 604) in concert with supply rules. Returning to FIG. 6, the system 600 can send security implements (e.g., control keys, license codes, passwords, etc.) to the computer 645. The computer 645 can utilize the security implements to unlock or use the rights on the wagering game machine object 603. The system 600 can also present options to share rights with other player accounts (e.g., provide limited access keys, sub-lease rights, etc.). For example, the sub-settings 606 include options for enabling abilities to personalize the wagering game machine object 603 with social contact accounts listed in a friends list 608. The system 600 can also provide additional abilities, change pricing, present personalization controls, etc., based on a player's social status. For example, the player interface 602 includes a status meter 612 that tracks the player's social standing in a wagering game related social network. The system 600 can refer to the status meter 612 to determine the player account's status level. Further, after providing rights to the player account, the system 600 can also store metadata in the wagering game machine object 603 so that others can see it (e.g., in FIG. 8, a wagering game machine object 803 presents an information panel 807 that can present lease information 809).

Figure 7:
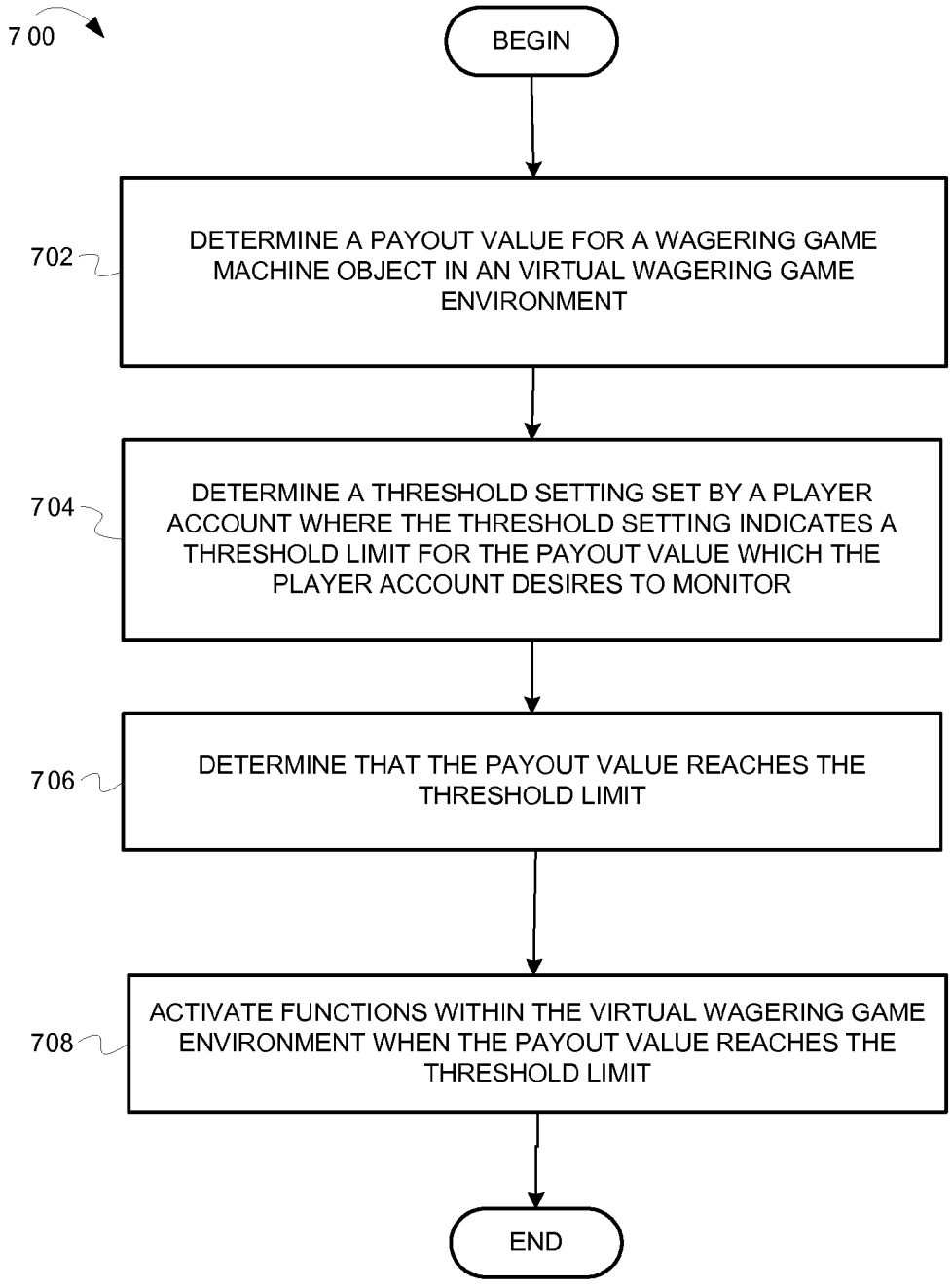
FIG. 7 is a flow diagram 700 illustrating notifying player accounts for changes in wagering game machine object's performance statistics, according to some embodiments.
Figure 8:
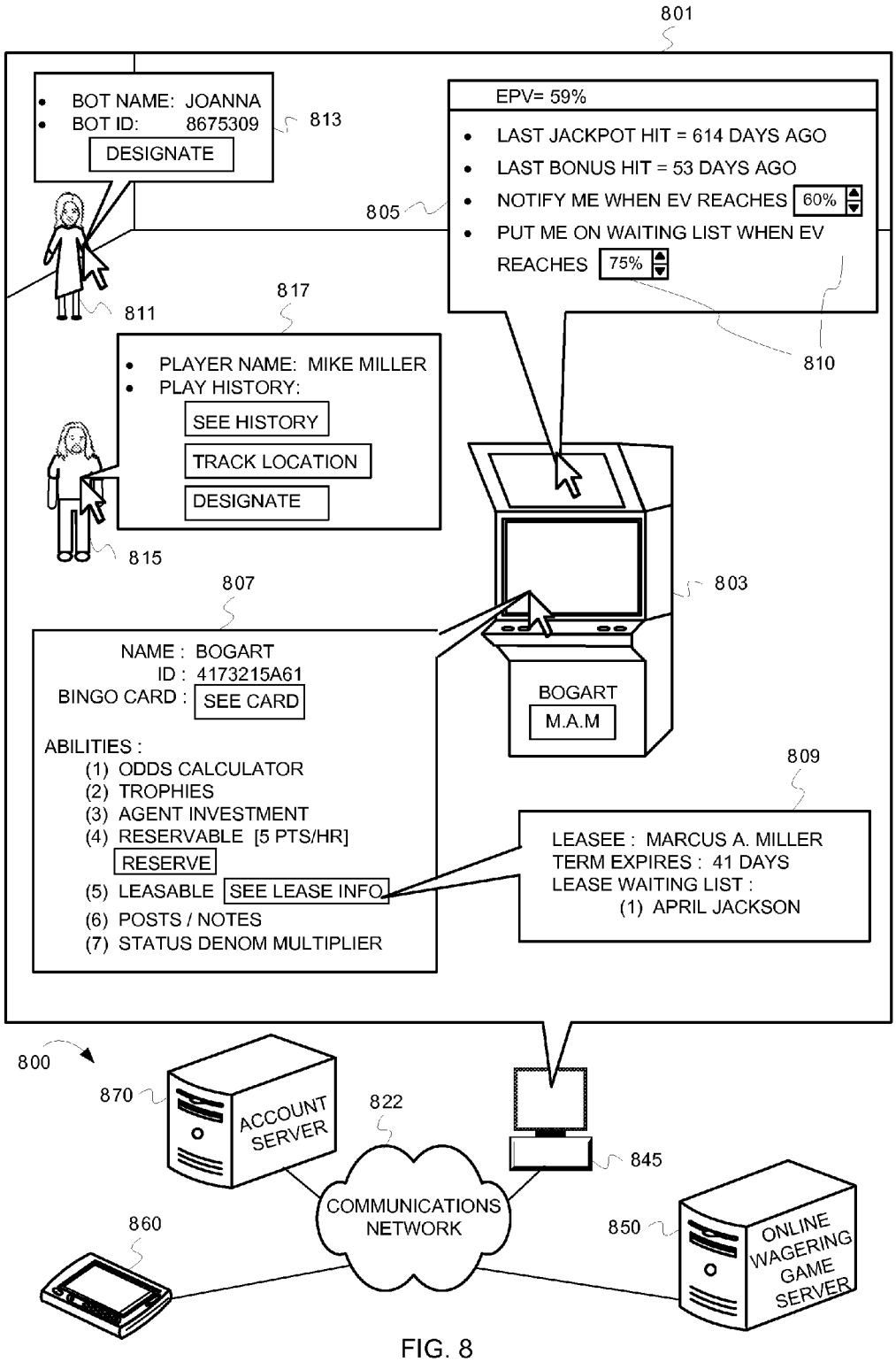
FIG. 8 is an illustration of a wagering game system 800, according to some embodiments.

FIG. 7 is a flow diagram ("flow") 700 illustrating notifying player accounts for changes in wagering game machine object's performance statistics, according to some embodiments. FIG. 8 is a conceptual diagram that helps illustrate the flow of FIG. 7, according to some embodiments. This description will present FIG. 7 in concert with FIG. 8. In FIG. 7, the flow 700 begins at processing block 702, where a wagering game system ("system") determines a payout value for a wagering game machine object in a virtual wagering game environment. The payout value can indicate an amount of winnings that the wagering game machine object has paid out over a period of time. In some embodiments, the system can calculate an expected payout value ("EPV") for the wagering game machine object, where the EPV value equates to a composite score (e.g., percentage score, point score, etc.) of factors affecting the wagering game machine object, including, but not limited to, a number of bonus awards awarded over time, a number of jackpots awarded over time, a number of player winnings over time, a record of wins since a player account has last played on that wagering game machine object, a number of wins over a number of spins, etc. In FIG. 8, an example wagering game system ("system 800") presents some example options and controls in a machine options panel 805 related to EPV scores, historic payout information, and notification options. The system 800 includes a computer system ("computer") 845 connected to an online wagering game server 850 via a communications network 822. The computer 845 presents a display 801 of a virtual wagering game environment hosted by the online wagering game server 850. The system 800 can also include an account server 870 and a wagering game machine 860, both connected to the communications network 822. The account server 870 can store and present control options for a player account that logs in to the virtual wagering game environment through the computer 845. The wagering game machine 860 can also access the virtual wagering game environment and present the display 801 from within a casino network. The computer 845 presents the machine options panel 805 for the wagering game machine object 803 in the virtual wagering game environment.

The flow 700 continues at processing block 704, where the system determines a threshold setting set by a player account where the threshold setting indicates a threshold limit for the payout value which the player account desires to monitor. For example, in FIG. 8, the machine options panel 805 includes monitoring controls 810 to set monitoring limits for the EPV (e.g., if the EPV is presented as a percentage, the monitoring controls 810 can set percentage values for monitoring the EPV).

The flow 700 continues at processing block 706, where the system determines that the payout value reaches the threshold limit. For example, in FIG. 8, after the player account has set the monitoring limits in the monitoring controls 810, the system will subsequently payout, or fail to payout, for wagering games. As a result, the EPV will increase or decrease. As the EPV changes, it may approach one or more of the monitoring limits set in the monitoring controls 810.

The flow 700 continues at processing block 708, where the system automatically activates functions within the virtual wagering game environment when the payout value reaches the threshold limit. For example, in FIG. 8, the system 800 can notify the player account that the payout value has reached the threshold limit. More specifically, when the EPV for the wagering game machine object 803 reaches one of the monitoring limits set in the monitoring controls 810, then the system 800 can send a notification message to the player account that set the monitoring limits. The system 800 can send the player a notification in the form of a pop-message, a chat message, a text message, an email, etc. Further, the system 800 can also automatically perform any, or more, of the following within the virtual wagering game environment after the limit is reached: placing the player account on a waiting list to play the wagering game machine object 803, sending a player bot to occupy the wagering game machine object 803 until the player's avatar can arrive, transporting the player account's avatar to the wagering game machine object 803, notifying a wagering game agent to play the wagering game machine object 803, triggering an agent investment for the wagering game machine object 803, placing side-bets on a player's activity on the wagering game machine object 803, etc.

Additional Example Embodiments

According to some embodiments, a wagering game system ("system") can provide various example devices, operations, etc., to control and present virtual wagering game environments. The following non-exhaustive list enumerates some possible embodiments.

- In some embodiments, the system can allow a player to play multiple wagering game machine objects at the same time
- In some embodiments, the system can provide machine bingo games. For example, each wagering game machine object can have an integrated, identifiable bingo card, or other card, instrument, or playing element used in other group games (e.g., roulette, community games, etc.).
- In some embodiments, the system can tie an online machine (e.g., a wagering game machine object) to a brick-and-mortar machine (e.g., an actual wagering game machine in a casino). The system can provide a shared random number generator to the online machine and the brick-and-mortal machine. The system can indicate which machines are "hot" whether online or on the casino floor.
- In some embodiments, the system can designate a lucky player or bot. For example, in FIG. 8, the system 800 can identify a player avatar 815, or a bot avatar 811, and present characteristics (e.g., bot characteristics 813 and player characteristics 817) that the player account feels are lucky or successful. The system 800 can also present search options for the player account to find the lucky players or bots. For instance, the player account can searches for a bot with a lucky series of numbers in its identification information, a player account can search for another player with a recent history of wins, etc. The system 800 can also provide controls for player accounts to chat, locate, reserve seats next to, or in other ways, interact with their designated players or bots.
- In some embodiments, the system can present search controls to search for the wagering game machine object, receive a payout search parameter (e.g., an EPV value), and search for the wagering game machine object using the payout search parameter. The system can use the search to find wagering game machine objects in a virtual wagering game environment that haven't hit a jackpot or bonus in a certain amount of time.
- In some embodiments, the system can show a history of players that have won on a wagering game machine object. The system can show anonymous information about the players that have won (e.g., show the location of a top winner, show an avatar name, show a login handle, show a player symbol, etc.) in place of personal identification information about the player.
- In some embodiments, the system can provide trophies or awards. The system can present meta-awards or meta-privileges above and beyond a wagering game machine object's normal abilities, like a high score, a medal or award, a virtual item, etc. The system can also show visual effects of an avatar to others (e.g., on a banner, in an advertisement, via a system chat console, etc.) for achievements that the player account accomplished.
- In some embodiments, the system can limit or expand the denomination values of a game or machine (e.g., the system can provide high denominations for only some machines, the system can change the denominations for a group of players based on status, etc).
- In some embodiments, the system can authorize a wagering agent or provide agent investments. For example, the system can provide controls so that a player account can invest money into a wagering game machine object, at the end of a wagering game session. Depending on the amount of money invested, the system can set parameters so that the investing player account can win a percentage of wins by subsequent players on the wagering game machine object (e.g., the player account can win money for a subsequent player's game play for a set number of plays/spins after the player account leaves the wagering game machine object—the player account can "piggy-back" win an amount equivalent to a portion of a subsequent player's winnings).
- In some embodiments, the system can reserve a wagering game machine object (e.g., reserve the wagering game machine object after a player finishes, reserve the wagering game machine object for use in a future slot tournament, reserve the wagering game machine object for use in a group for a group event, etc.).
- In some embodiments, the system can present controls so that a player can use points to get on to a wagering game machine object, to move up on a waiting list, to obtain abilities, etc.
- In some embodiments, the system can present machine abilities based on a player's status (e.g., present abilities to move up on a wait list based on player status, present controls to control a wagering game machine object based on status levels, present hidden or secret machines based on player status, etc.). The system can also present entire locations (e.g., rooms, regions, etc.) based on a player's status (e.g., an entire VIP casino).
- In some embodiments, the system can provide a special type of points (e.g., points for game types, points for community games, points for tournament games, etc.) to control, use, see or otherwise interact with wagering game machine objects (e.g., the system can provide community game points which a player can use to access community wagering game machine objects).
- In some embodiments, the system can provide switches to turn on or off background sounds, news feeds, levels of information, etc.
- In some embodiments, the system can allow player accounts to look over the shoulders of other player accounts (or player bots) that are playing on wagering game machine objects. The system thus enhances the excitement of available games, making them more desirable, if players can see and experience what other players are playing. The system can show an animation of the player or bot reacting to the game, thus making the game appear exciting. The system can also replay big wins that others players have had recently on the wagering games.
- In some embodiments, the system can present chat controls so that players can communicate with other player and/or bots within a virtual wagering game environment. The system can present bots that move or react animatedly to conversation being presented in the chat.
- In some embodiments, the system can provide an odds calculator on a wagering game machine object to calculate odds for potential wins or losses in wagering game.
- In some embodiments, the system can unlock bonus games, themes, etc. after a certain number of bets, pay in, etc. on a wagering game machine object. The system can also offer new games to smaller, exclusive groups of player accounts who play the previous versions the most.
- In some embodiments, the system can control access to waiting lists for the wagering game machine object based on control or access rights (e.g., a player account with access rights to a wagering game machine object may control the position of friends and other social contact accounts on the waiting list).

In some embodiments, the system can provide a referral award to a player account for referring one or more additional player accounts to a wagering game machine object. In some embodiments, the system can make referred players eligible to play the wagering game machine object in a wagering game tournament.

Additional Example Operating Environments

This section describes example operating environments, systems and networks, and presents structural aspects of some embodiments.

Wagering Game Machine Architecture

Figure 9:
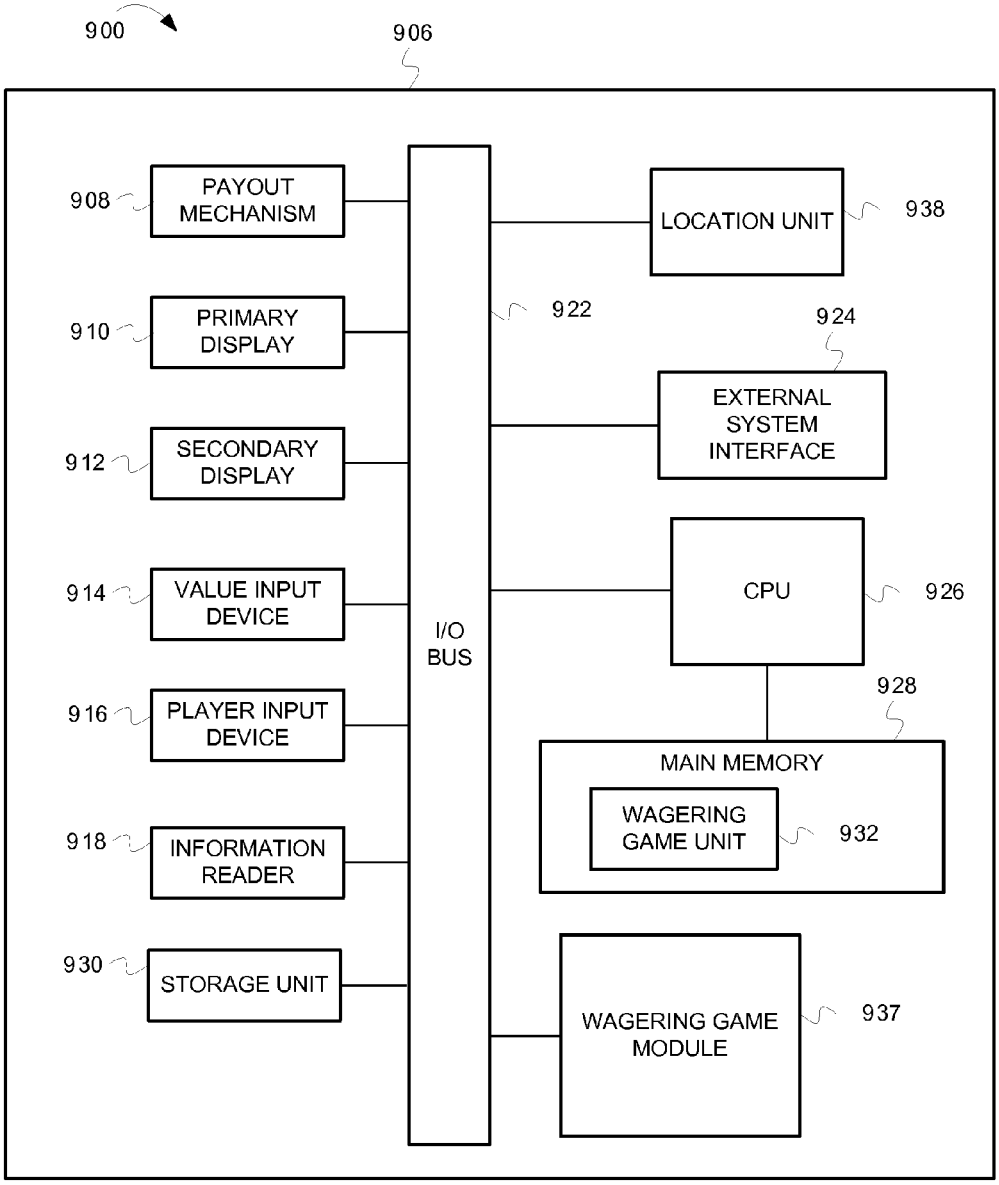
FIG. 9 is an illustration of a wagering game machine architecture 900, according to some embodiments.

FIG. 9 is a conceptual diagram that illustrates an example of a wagering game machine architecture 900, according to some embodiments. In FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game unit 932. In some embodiments, the wagering game unit 932 can present wagering games, such as video poker, video black jack, video slots, video lottery, reel slots, etc., in whole or part.

The CPU 926 is also connected to an input/output ("I/O") bus 922, which can include any suitable bus technologies, such as an AGTL+ frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems (e.g., wagering game networks). The external system interface 924 can include logic for exchanging information over wired and wireless networks (e.g., 802.11g transceiver, Bluetooth transceiver, Ethernet transceiver, etc.)

The I/O bus 922 is also connected to a location unit 938. The location unit 938 can create player information that indicates the wagering game machine's location/movements in a casino. In some embodiments, the location unit 938 includes a global positioning system (GPS) receiver that can determine the wagering game machine's location using GPS satellites. In other embodiments, the location unit 938 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 9, in some embodiments, the location unit 938 is not connected to the I/O bus 922.

In some embodiments, the wagering game machine 906 can include additional peripheral devices and/or more than one of each component shown in FIG. 9. For example, in some embodiments, the wagering game machine 906 can include multiple external system interfaces 924 and/or multiple CPUs 926. In some embodiments, any of the components can be integrated or subdivided.

In some embodiments, the wagering game machine 906 includes a wagering game module 937. The wagering game module 937 can process communications, commands, or other information, where the processing can control and present virtual wagering game environments.

Furthermore, any component of the wagering game machine 906 can include hardware, firmware, and/or machine-readable media including instructions for performing the operations described herein.

Mobile Wagering Game Machine

Figure 10:
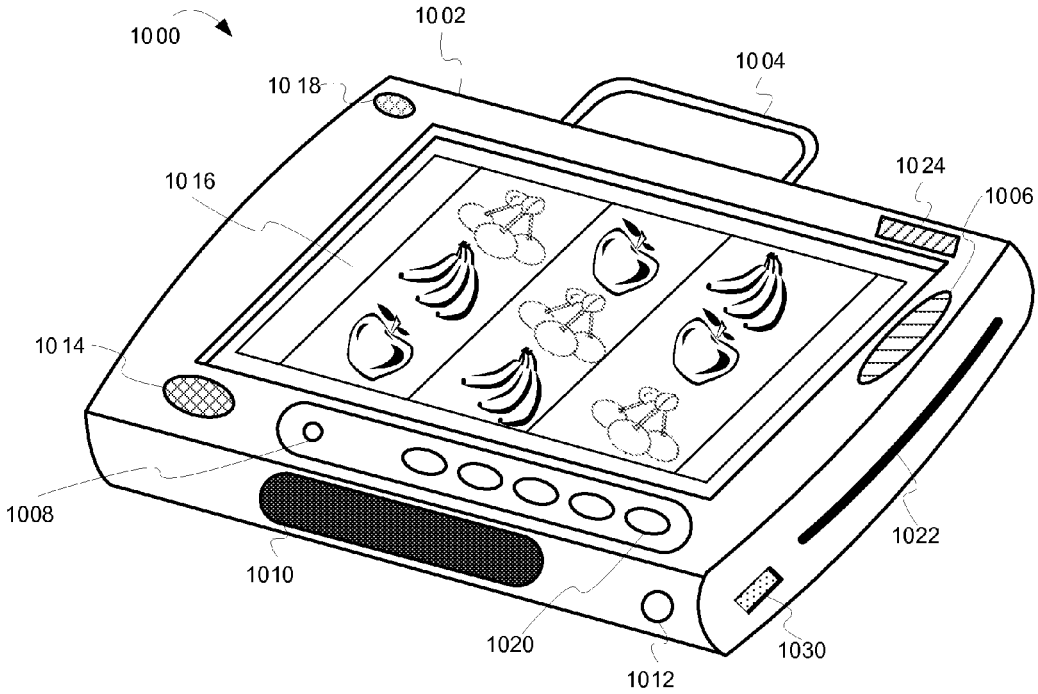
FIG. 10 is an illustration of a mobile wagering game machine 1000, according to some embodiments.

FIG. 10 is a conceptual diagram that illustrates an example of a mobile wagering game machine 1000, according to some embodiments. In FIG. 10, the mobile wagering game machine 1000 includes a housing 1002 for containing internal hardware and/or software such as that described above vis-à-vis FIG. 9. In some embodiments, the housing has a form factor similar to a tablet PC, while other embodiments have different form factors. For example, the mobile wagering game machine 1000 can exhibit smaller form factors, similar to those associated with personal digital assistants. In some embodiments, a handle 1004 is attached to the housing 1002. Additionally, the housing can store a foldout stand 1010, which can hold the mobile wagering game machine 1000 upright or semi-upright on a table or other flat surface.

The mobile wagering game machine 1000 includes several input/output devices. In particular, the mobile wagering game machine 1000 includes buttons 1020, audio jack 1008, speaker 1014, display 1016, biometric device 1006, wireless transmission devices (e.g., wireless communication units 1012 and 1024), microphone 1018, and card reader 1022. Additionally, the mobile wagering game machine can include tilt, orientation, ambient light, or other environmental sensors.

In some embodiments, the mobile wagering game machine 1000 uses the biometric device 1006 for authenticating players, whereas it uses the display 1016 and the speaker 1014 for presenting wagering game results and other information (e.g., credits, progressive jackpots, etc.). The mobile wagering game machine 1000 can also present audio through the audio jack 1008 or through a wireless link such as Bluetooth.

In some embodiments, the wireless communication unit 1012 can include infrared wireless communications technology for receiving wagering game content while docked in a wager gaming station. The wireless communication unit 1024 can include an 802.11G transceiver for connecting to and exchanging information with wireless access points. The wireless communication unit 1024 can include a Bluetooth transceiver for exchanging information with other Bluetooth enabled devices.

In some embodiments, the mobile wagering game machine 1000 is constructed from damage resistant materials, such as polymer plastics. Portions of the mobile wagering game machine 1000 can be constructed from non-porous plastics which exhibit antimicrobial qualities. Also, the mobile wagering game machine 1000 can be liquid resistant for easy cleaning and sanitization.

In some embodiments, the mobile wagering game machine 1000 can also include an input/output ("I/O") port 1030 for connecting directly to another device, such as to a peripheral device, a secondary mobile machine, etc. Furthermore, any component of the mobile wagering game machine 1000 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

determining a first number that represents an amount of player avatars within a virtual wagering game environment that are not using at least one of a plurality of virtual wagering game machine objects in the virtual wagering game environment;

determining a second number that represents a subset of the plurality of virtual wagering game machine objects within the virtual wagering game environment that are not being used by the player avatars;

comparing the first number to the second number;

based on the comparing, determining that the second number is greater than the first number; and causing one or more of the subset of the plurality of virtual wagering game machine objects to become unavailable for use by the player avatars in response to the determining that the second number is greater than the first number.

2. The computer-implemented method of claim 1, wherein the determining that the second number is greater than the first number comprises determining that the second number is more than one value greater than the first number, and wherein the causing the one or more of the subset of the plurality of virtual wagering game machine objects to become unavailable for use by the player avatars comprises causing the subset of the plurality of virtual wagering game machines objects to be either only one value more than, only one value less than, or equal in value to the number of the player avatars.

3. The computer-implemented method of claim 1, wherein the causing the one or more of the subset of the plurality of virtual wagering game machine objects to become unavailable for use by the player avatars comprises positioning one or more player bots at the one or more of the subset of the plurality of virtual wagering game machine objects making the one or more of the subset of the plurality of virtual wagering game machine objects unavailable for use by the player avatars.

4. The computer-implemented method of claim 1, wherein the causing the one or more of the subset of the plurality of virtual wagering game machine objects to become unavailable for use by the player avatars comprises removing the one or more of the subset of the plurality of virtual wagering game machine objects from the virtual wagering game environment.

5. The computer-implemented method of claim 4, wherein the removing the one or more of the subset of the plurality of virtual wagering game machine objects is according to performance statistics associated with the one or more of the subset of the plurality of virtual wagering game machine objects.

6. The computer-implemented method of claim 1 further comprising:

determining that at least one of the subset of the plurality of virtual wagering game machine objects is sponsored by a sponsor that offers gifts for using the at least one of the subset of the plurality of virtual wagering game machine objects; and ensuring that the at least one of the subset of the plurality of virtual wagering game machine objects remains available for use by the player avatars.

7. One or more non-transitory machine-readable storage media having instructions stored thereon, which when executed by a set of one or more processors causes the set of one or more processors to perform operations comprising:

determining a first number that represents an amount of player avatars within a wagering game environment that are not using virtual wagering game machine objects in the wagering game environment;

determining a second number that represents an amount of the virtual wagering game machine objects within the wagering game environment that are not being used by the player avatars;

comparing the first number to the second number;

based on the comparing, determining that the second number is greater than the first number; and causing one or more of the virtual wagering game machine objects to become unavailable for use by the player avatars in response to the determining that the second number is greater than the first number.

8. The one or more non-transitory machine-readable storage media of claim 7, wherein the operation of determining that the second number is greater than the first number includes an operation comprising determining that the second number is more than one value greater than the first number, and wherein the operation of causing the one or more of the virtual wagering game machine objects to become unavailable for use by the player avatars includes an operation comprising causing the amount of the virtual wagering game machine objects within the wagering game environment that are not being used to be either only one value more than, only one value less than, or equal in value to the first number.

9. The one or more non-transitory machine-readable storage media of claim 7, wherein the operation of causing the one or more of the virtual wagering game machine objects to become unavailable for use by the player avatars includes an operation comprising positioning one or more player bots at the one or more of the virtual wagering game machine objects making the one or more of the virtual wagering game machine objects unavailable for use by the player avatars.

10. The one or more non-transitory machine-readable storage media of claim 7, wherein the operation of causing the one or more of the virtual wagering game machine objects to become unavailable for use by the player avatars includes an operation comprising removing one or more of the virtual wagering game machine objects from the virtual wagering game environment.

11. The one or more non-transitory machine-readable storage media of claim 10, wherein the operation of the removing the one or more of the virtual wagering game machine objects is based on performance statistics of one or more of the virtual wagering game machine objects within the wagering game environment that are not being used.

12. The one or more non-transitory machine-readable storage media of claim 7, said operations further comprising:

determining that at least one of the virtual wagering game machine objects within the wagering game environment that are not being used is sponsored by a sponsor that offers gifts for using the at least one of the virtual wagering game machine objects; and ensuring that the at least one of the virtual wagering game machine objects remains available for use by the player avatars.

13. A system comprising:

one or more processors; and one or more memory storage devices configured to store instructions which, when executed by at least one of the one or more processors, cause the system to determine a number of player avatars within a boundary of a location of a virtual wagering game environment, wherein the number of the player avatars are not using virtual wagering game machine objects, determine a number of the virtual wagering game machine objects, within the virtual wagering game environment, that are not being used by the player avatars, determine that the number of the virtual wagering game machine objects is greater than the number of the player avatars, and cause one or more of the number of virtual wagering game machine objects to become unavailable for use by the player avatars based on determination that the number of the virtual wagering game machine objects is greater than the number of the player avatars.

14. The system of claim 13, wherein the instruction to determine that the number of the virtual wagering game machine objects is greater than the number of the player avatars includes an instruction to determine that the number of the virtual wagering game machines objects not being used by the player avatars is more than one value greater than the number of the player avatars, and wherein the instruction to cause the one or more of the number of the virtual wagering game machine objects to become unavailable for use by the player avatars includes an instruction to cause the number of the virtual wagering game machines objects to be either only one value more than, only one value less than, or equal in value to the number of the player avatars.

15. The system of claim 13, wherein the instruction to cause the one or more of the number of the virtual wagering game machine objects to become unavailable for use by the player avatars includes an instruction to position one or more player bots at the one or more of the number of the virtual wagering game machine objects to make the one or more of the number of the virtual wagering game machine objects unavailable for use by the player avatars.

16. The system of claim 13, wherein the instruction to cause the one or more of the number of the virtual wagering game machine objects to become unavailable for use by the player avatars includes an instruction to remove one or more of the number of the virtual wagering game machine objects from the virtual wagering game environment.

17. The system of claim 16, wherein the instruction to remove the one or more of the number of the virtual wagering game machine objects is according to performance statistics associated with the one or more of the number of the virtual wagering game machine objects.

18. The system claim 13, wherein the one or more memory storage devices are configured to store instructions which, when executed by at least one of the one or more processors, further cause the system to determine that at least one of the one or more of the number of the virtual wagering game machine objects are sponsored by a sponsor that offers gifts for using the at least one of the virtual wagering game machine objects; and ensure that the at least one of the one or more of the number of the virtual wagering game machine objects remains available for use by the player avatars.

19. An apparatus comprising:

at least one processor; and at least one memory storage device configured to store instructions which, when executed by the at least one processor, causes the apparatus to determine a first number that represents an amount of player avatars within a virtual wagering game environment that are not using at least one of a plurality of wagering game machine objects in the virtual wagering game environment, determine a second number that represents a subset of the plurality of virtual wagering game machine objects, wherein the subset of the plurality of virtual wagering game machine objects are not being used by the player avatars, based on comparison of the first number to the second number, determine that second number is greater than the first number, and in response, cause one or more of the subset of the plurality of virtual wagering game machine objects to become unavailable for use by the player avatars.

20. The apparatus of claim 19, wherein the instruction to determine that the second number is greater than the first number includes an instruction to determine that the second number is more than one value greater than the first number, and wherein the instruction to cause the one or more of the subset of the plurality of virtual wagering game machine objects to become unavailable for use by the player avatars includes an instruction to cause the subset of the plurality of virtual wagering game machines objects to be either only one value more than, only one value less than, or equal in value to the number of the player avatars.

21. The apparatus of claim 19, wherein the instruction to cause the one or more of the subset of the plurality of virtual wagering game machine objects to become unavailable for use by the player avatars includes an instruction to position one or more player bots at the one or more of the subset of the plurality of virtual wagering game machine objects to make the one or more of the subset of the plurality of virtual wagering game machine objects unavailable for use by the player avatars.

22. The apparatus of claim 19, wherein the instruction to cause the one or more of the subset of the plurality of virtual wagering game machine objects to become unavailable for use by the player avatars includes an instruction to disable use of the one or more of the subset of the plurality of virtual wagering game machine objects from the virtual wagering game environment according to performance statistics associated with the one or more of the virtual wagering game machine objects.

23. The apparatus claim 19, wherein the one or more memory storage devices are configured to store instructions which, when executed by at least one of the one or more processors, further cause the apparatus to determine that at least one of the subset of the plurality of virtual wagering game machine objects is sponsored by a sponsor that offers gifts for using the at least one of the subset of the plurality of virtual wagering game machine objects; and ensure that the at least one of the subset of the plurality of virtual wagering game machine objects remains available for use by the player avatars.

24. An apparatus comprising:

means for determining a first number that represents an amount of player avatars that are not using virtual wagering game machine objects within a virtual wagering game environment;

means for determining a second number that represents at least a portion of the virtual wagering game machine objects within the virtual wagering game environment that are not being used by the amount of player avatars;

means for determining that the second number is greater than the first number; and means for causing one or more of the at least a portion of the virtual wagering game machine objects to become unavailable for use by the amount of player avatars in response to the determining that the second number is greater than the first number.

25. The apparatus of claim 24, wherein the means for determining that the second number is greater than the first number comprises means for determining that the second number is more than one value greater than the first number, and wherein the means for causing the one or more of the at least a portion of the virtual wagering game machine objects to become unavailable for use by the amount of player avatars comprises causing the at least a portion of the virtual wagering game machines objects to be either only one value more than, only one value less than, or equal in value to the first number.

26. The apparatus of claim 24, wherein the means for causing the one or more of the at least a portion the virtual wagering game machine objects to become unavailable for use by the amount of player avatars comprises means for positioning one or more player bots at the one or more of the at least a portion the virtual wagering game machine objects making the one or more of the at least a portion the virtual wagering game machine objects unavailable for use by the player avatars.

27. The apparatus of claim 24, wherein the means for causing the one or more of the at least a portion the virtual wagering game machine objects to become unavailable for use by the amount of player avatars comprises means for causing the one or more of the at least a portion the virtual wagering game machine objects to become deactivated according to performance statistics associated with the one or more of the at least a portion the virtual wagering game machine objects.

28. The apparatus of claim 24 further comprising:

determining that at least one of the portion of the virtual wagering game machine objects that are not being used is sponsored by a sponsor that offers gifts for using the at least one of the virtual wagering game machine objects; and ensuring that the at least one of the portion of the virtual wagering game machine objects remains available for use by the player avatars.

* * * * *